United States Patent [19]

Terry et al.

[11] 4,314,319

[45] Feb. 2, 1982

[54] ADJUSTABLE LAMPS

[75] Inventors: John V. Terry, Wasperton House, near Warwick, Warwickshire, England; Raymond M. Terry, Newbold House, Newbold-on-Stour, Warwickshire, England; Ian A. Atkins, Wychbold, England

[73] Assignees: John Victor Terry, Warwickshire; Raymond Michael Terry, Newbold-one-Stour, both of England

[21] Appl. No.: 56,964

[22] Filed: Jul. 12, 1979

[30] Foreign Application Priority Data

Aug. 26, 1978 [GB] United Kingdom ..... 34780/78

[51] Int. Cl.[3] ..... F21V 21/18

[52] U.S. Cl. ..... 362/287; 362/33; 362/371; 362/389; 362/427

[58] Field of Search ..... 362/290, 418, 427, 430, 362/287, 370, 371, 389, 33, 98

[56] References Cited

U.S. PATENT DOCUMENTS

| | | | |
|---|---|---|---|
| 494,116 | 3/1893 | Barber | 362/402 X |
| 1,025,537 | 7/1912 | Pitel | 362/402 X |
| 2,740,039 | 3/1956 | Phillips | 362/427 X |
| 2,910,310 | 10/1959 | Mulac | 362/427 |
| 3,012,798 | 12/1961 | Berger | 362/427 |
| 3,280,322 | 10/1966 | Kirkeby | 362/402 |
| 3,604,916 | 9/1971 | Adra et al. | 362/427 |
| 3,778,610 | 12/1973 | Wolf | 362/418 |
| 3,820,752 | 6/1974 | Oram | 362/427 X |
| 4,139,883 | 2/1979 | Ilzig et al. | 362/427 |
| 4,165,530 | 8/1979 | Sowden | 362/427 |
| 4,190,880 | 2/1980 | Esaki | 362/402 X |
| 4,213,172 | 7/1980 | Scattolin et al. | 362/402 X |

*Primary Examiner*—Peter A. Nelson

*Attorney, Agent, or Firm*—C. O. Marshall, Jr.

[57] ABSTRACT

An adjustable lamp is provided (FIG. 1) comprising a main arm 12 which is pivoted to a base at one end and carries the lamp housing at the other end. The angular position of the arm relative to the base is controlled by a link also pivoted to the base and to a sliding connection on the arm. There is adjustable frictional resistance to sliding, and additionally the link is spring urged to counterbalance the increasing turning moment as the arm moves towards the horizontal position.

1 Claim, 4 Drawing Figures

ADJUSTABLE LAMPS

This invention relates to adjustable lamps.

One well-known desk lamp comprises a heavy base, for stability, and which is intended to stand on a desk, table or the like (or alternatively the base may comprise a bracket or clamp which is intended to be fixed to a wall or other surface). A fork is connected to the base, a first arm is pivoted to the fork, a second arm is pivoted to the first arm, and the lamp housing (for example the shade or reflector and the bulb holder) is pivoted to the second arm. In this construction the first arm comprises an elongated parallelogram; the adjacent end of the second arm forms a first short side of this parallelogram, and a set of springs is used to couple the parallelogram at the second of its short sides to the fork. This complex arrangement is intended to enable the height of the lamp shade or like to be adjusted relative to the base by a mere touch on the shade or arm, and so that the adjusted height will remain unaltered until a further adjustment is required, without involving the use of separate locking devices. In practice the arrangement works reasonably well although the lamp can be adjusted to positions where it is not in equilibrium, i.e. when the lamp will move from the adjusted position.

It is an object of the invention to produce a construction of like effect, but using fewer parts so as to be not only cheaper to manufacture but also aesthetically improved.

In accordance with the invention a lamp comprising a base, an arm pivoted on the base and carrying a lamp housing at its free end, and a link also pivoted to the base and making sliding frictional connection with the arm so that the pivot points of the arm and link together with the connection point at the link and arm form the apices of a triangle, is characterised in that the link is pivoted to a sliding connector block and the arm extends through the block, and in that a spring is located in the base to provide resistance to movement of the arm towards the horizontal position with respect to the base.

When the arm is vertical, there is little turning moment due to the lamp housing, but as the angle of inclination of the arm reduces, the turning moment increases. The spring may be arranged to become effective only when the angle reduces below a predetermined value which may be the maximum angle likely in normal use of the lamp.

Preferably the frictional resistance to sliding of the link connection on the arm is adjustable, and this may be particularly valuable if the base is to be either a weighted but free standing one, or a wall bracket, table clamp or other fixed mounting, since the loading which can be applied by a user in adjusting the lamp is much greater in the latter case and additional frictional resistance may be desirable.

One presently preferred embodiment of the invention is now more particularly described with reference to the accompanying drawings wherein.

Figures 1, 2:
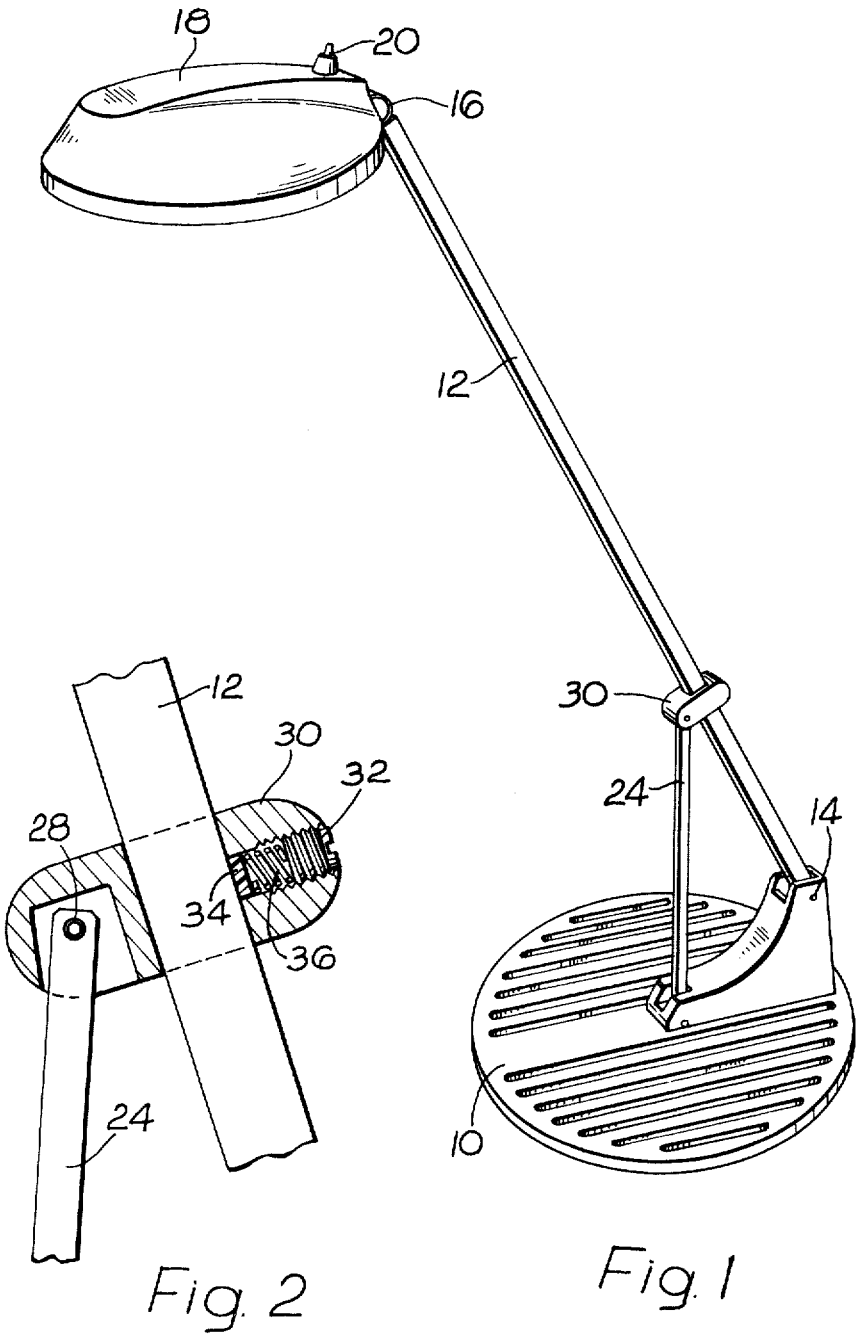
FIG. 1 is a perspective view of a complete lamp.
FIG. 2 is a fragmentary sectional elevation showing the sliding frictional connection of the arm and link of the same.
Figure 3:
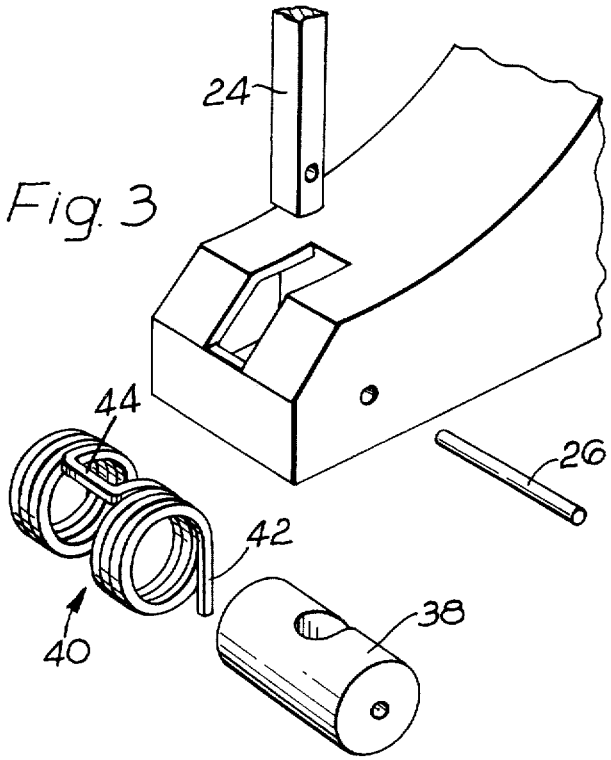
FIG. 3 is a fragmentary exploded perspective view showing the parts providing spring loading for the link at the base.

Referring first to FIG. 1, the lamp comprises a free standing heavy base generally indicated by the reference numeral 10, an arm 12, which may be of square cross section tube which is pivoted at its lower end upon a pin 14 to the base, and is hingedly connected at 16 to a lamp housing 18 which comprises a shade or reflector, a bulb holder and an on/off switch 20 for the lamp.

Figure 4:
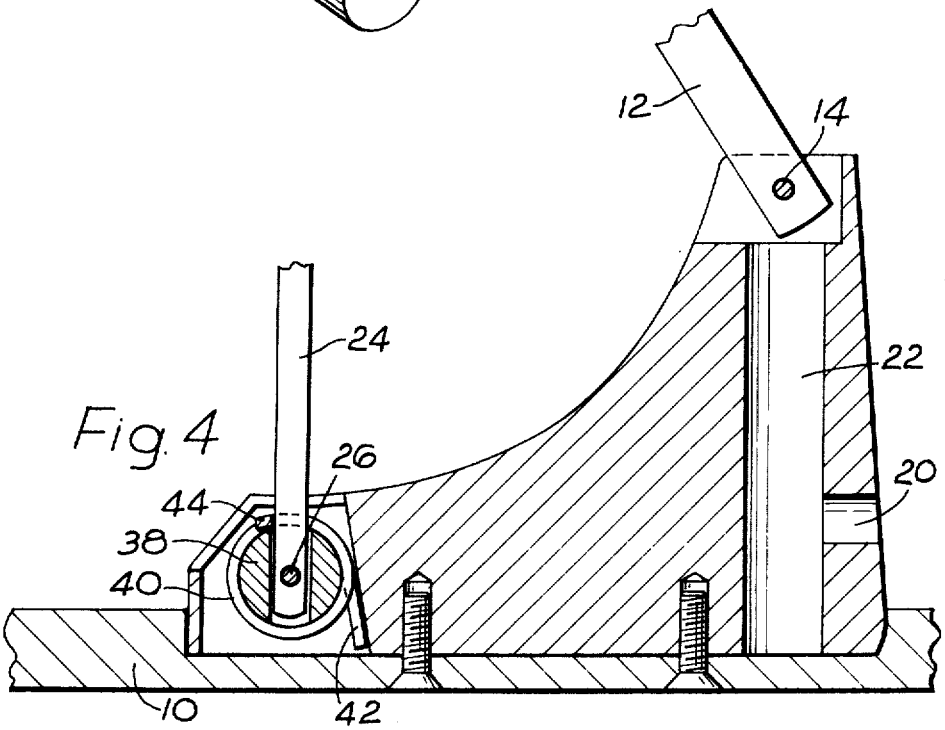
FIG. 4 is a fragmentary sectional elevation of the base.

The electric conductor wires may be led through passages 20, 22 in the base (FIG. 4) along the interior of the arm 12, through the hinge joint 16 and into the housing 18, so that they are not exposed to view and incidentally are protected against accidental damage.

The principal adjustment of the lamp is to vary the angle of the arm 12 between a near horizontal and a near vertical position, thus varying the height of the housing 18 above the notional surface on which the base 10 rests. Additionally, the lamp housing 18 may be turned by means of the hinge, usually so as to keep the housing generally parallel to the table or desk top on which the base 10 stands, but sometimes it may be desired to turn the lamp to non-parallel positions.

To hold the arm 12 in any selected angle, a link 24 is provided which is pivoted on a pin 26 in the base and is at opposite end on pin 28 to a frictional sliding connector block 30. The latter is threaded by the arm 12, and it will be appreciated that in angular adjustment of arm 12 the block 30 slides along the length of the arm and offers a frictional resistance to the sliding, tending to hold the block and the link in any selected position and thus enable the lamp to remain in any particular adjusted position selected by the user.

The block 30 may be made of any suitable plastics material, and the dimensions of the aperture through which the arm 12 extends are carefully selected to provide the required frictional resistance to sliding. However, in order to provide a substantially constant frictional resistance after a certain amount of wear has taken place, or whilst allowing substantial manufacturing tolerances or for other reasons, an adjuster screw 32 is provided engaged with a screwthreaded bore in the block 30, and a friction pad 34 seats against the arm with a spring 36 interposed between the latter and the screw. This has the further advantage of allowing the degree of frictional resistance to be varied, for example in the event that a clamp type base is provided instead of the weighted base illustrated, since the user may then apply substantially greater loading to the arm in adjustment movements without the risk of the base moving.

Pin 26 extends through a bush 38 which forms a support for a torsion spring 40, the spring having tails 42 which abut a surface in the base part which journals the pin and bush, and the spring also having a bridge 44 to abut the link. The effect is that when the arm 12 moves from a near vertical position, anticlockwise about its pivot 14 in FIG. 4, the link 24 moves towards a vertical position (also anticlockwise about its pin 26) until the link abuts the bridge 44. Up to this point there is no spring loading effective. As the movement continues, the link displaces the bridge 44 in the same anticlockwise direction, and because the torsion spring cannot turn as a whole owing to the abutment of the tails 42 with the base part, the spring is wound up and stressed as the arm movement continues, and the nearer the arm 12 approaches to the horizontal, the greater the spring loading on the link. This can more or less provide a counterbalance for the increasing turning moment caused by the weight of the lamp housing as it moves horizontally further from the pivot 14. Ideally, it is possible to move the arm 12 in the said counterclockwise direction by a finger touch, and for the arm to remain in any adjusted position when the touch is released, and for the same to be possible in the clockwise direction of adjustment.

We claim:

1. A lamp comprising a base, an arm pivoted to the base and carrying a lamp housing at its free end, and a link which supports the arm and which is also pivoted to the base and to a member having a sliding frictional connection with the arm, so that the points at which the arm and link are pivoted to the base, together with a connection point of the link and arm, form the apices of a triangle, wherein the improvement comprises a torsion spring which is wound around the axis of a pin on which the link is pivoted to the base, the link, when holding the arm upright, having a lost motion connection with the spring, and the spring, when the link and arm are swung to take up the lost motion connection, being arranged to apply torque to the link to resist further movement of the link and arm toward a more horizontal position, and to assist in returning the link and arm from such a more horizontal position.

* * * * *